United States Patent [19]

Yurman

[11] Patent Number: 5,074,127

[45] Date of Patent: Dec. 24, 1991

[54] HIGHLY FLEXIBLE JEWELRY BAND MATERIAL

[76] Inventor: David N. Yurman, 186 Franklin St., New York, N.Y. 10013

[21] Appl. No.: 444,041

[22] Filed: Nov. 30, 1989

[51] Int. Cl.[5] ..... A44C 5/00

[52] U.S. Cl. ..... 63/3; 63/11

[58] Field of Search ..... 63/2, 3, 4, 5.1, 5.2, 63/11; 2/170; 57/200, 236

[56] References Cited

U.S. PATENT DOCUMENTS

| | | | |
|---|---|---|---|
| 296,127 | 4/1884 | Burnett | 63/2 X |
| 297,874 | 4/1884 | Thiery | 63/11 |
| 1,070,661 | 8/1913 | Baudewyns | 57/200 X |
| 1,726,700 | 9/1929 | Forstner | 63/5.1 |
| 2,061,559 | 11/1936 | Brown et al. | 57/200 X |
| 3,686,734 | 8/1972 | Labarte et al. | 63/3 X |

FOREIGN PATENT DOCUMENTS

| | | | |
|---|---|---|---|
| 19351 | of 1914 | United Kingdom | 57/200 |

*Primary Examiner*—Kenneth J. Dorner
*Assistant Examiner*—J. Bonifanti
*Attorney, Agent, or Firm*—Handal & Morofsky

[57] ABSTRACT

A highly flexible jewelry band material (100) comprising a plurality of interlocked helical members (134–148) with articulated surfaces (152,154) is disclosed.

9 Claims, 3 Drawing Sheets

HIGHLY FLEXIBLE JEWELRY BAND MATERIAL

TECHNICAL FIELD

The present invention relates to a metal band material for use in the fabrication of jewelry, particularly bracelets and necklaces.

BACKGROUND ART

From ancient times, precious metal and other items of jewelry have seen extensive us in both civilized and aboriginal cultures. For example, necklaces, bracelets, and related items have been used in the western world since the earliest ancient times.

One of the primary problems involved in the fabrication of metal jewelry is the acute scarcity of materials, often silver and gold. In particular, the use of a relatively large amount of material, which would normally be required to make a significant impression, requires large amounts of precious metal and therefore results in a cost which makes jewelry of this sort prohibitive to all but the most well-to-do person. While there exists a great number of jewelry items made in such a way, as a result of economic pressures, many alternatives to jewelry which weighs as much as it appears to weigh have been found.

For example, in many cases, a bracelet may be made of a piece of sheet metal which is curved to fit around a wrist and which has its lateral edges turned inwardly to simulate a cylindrical or half-cylindrical configuration. The problem with such a structure is, of course, that it does not wear well and bending tends to deform the inwardly curving portion which gives the piece its dimensionality.

Another approach is epitomized by the so-called Navajo Indian silver-turquoise jewelry of the American Southwest. Here, silver is the customary material and the bracelets are made by taking flat pieces of material and bending them into a configuration which mirrors the shape of the wrist of the wearer. While such pieces do not have the dimensionality of other pieces, they are flexible and tend to wear well.

Yet another approach is the use of so-called half-hollow chains which comprise a number of links which are connected with each other and appear to be a solid chain, but due to their particular configuration, are not free to turn upside down to expose that the various links in the chain are hollowed out on the underside. While such an approach is quite effective, it suffers from the limitation of a limited range of possibilities in terms of appearance and does not lend itself well to the sleek integrated modern designs that are popular in jewelry today. Moreover, the individual parts of such a bracelet must be individually cast and a great deal of handwork is required to finish and assemble such bracelets.

Yet another approach is the use of a number of relatively thin and thus light and inexpensive parts which are linked to a central chain in a configuration often used as, for example, a charm bracelet. However, the lightness of the various parts is evident, upon inspection of the piece, and it fails to have the prestigious appearance of heavier pieces.

In an attempt to address some of these problems, I conceived a number of years ago a jewelry band material in which a tube was formed by eight smaller tubes which were swirled into individual interlocking helixes and then turned into a bracelet shape. This particular configuration was exceptionally valuable insofar as it gave the impression of a heavy solid sculptured band of gold or silver, has sufficient weight to fall properly when it was being worn and, at the same time, could be manufactured by machine and worked relatively inexpensively. However, this structure also had a tendency, when flexed, to stay in the changed position. Accordingly, this material, for many uses, is best employed with a hinge at the desired point of flexure.

SUMMARY OF THE INVENTION

The invention is intended to provide a remedy. It solves the problem of how to provide a strong inexpensive band material, while eliminating the need for hinges or the like, and maintaining a degree of flexibility which minimizes permanent deformation. The invention, as claimed, is drawn to an improved bracelet material of the multi-tube type. At the same time, increased flexibility is achieved as compared to prior art band materials.

Particular advantage can be obtained by forming the arcuate shapes of the component individual tubes by forming a helix into the tube with an orientation which is opposite the orientation in which the individual tubes are turned into a larger tube. This causes the individual peaks of one tube to mate with the troughs and peaks, respectively, of both its adjacent tubes in the multi-tube helix configuration.

BRIEF DESCRIPTION OF THE DRAWINGS

One way of carrying out the invention is described in detail below with reference to drawings which illustrate only several specific embodiments of the invention, in which.

BEST MODE FOR CARRYING OUT THE INVENTION

Figure 1:
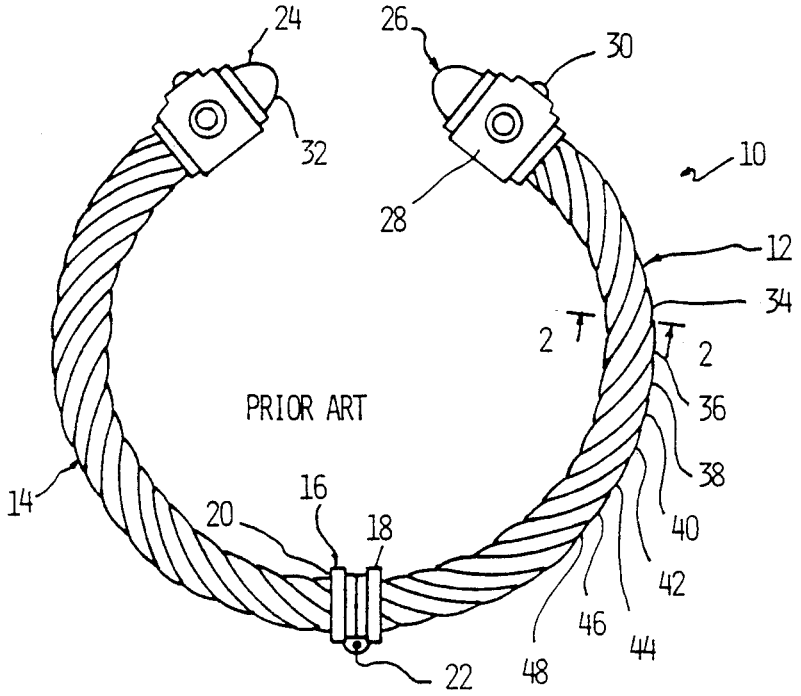
FIG. 1 is a plan view of my prior art material formed into a hinged bracelet.

Referring to FIG. 1, the structure of the prior art band material is illustrated in the embodiment of a prior art bond or bracelet 10. Bracelet 10 comprises a right body portion 12 and a left body portion 14. Right body portion 12 and left body portion 14 are joined together by a hinge 16 which comprises a right hinge member 18 and a left hinge member 20. Right hinge member 18 and left hinge member 20 are joined to each other to pivot about a pin 22 whereby the distance between decorative end caps 24 and 26 may be increased to allow the wrist of a wearer to pass through the gap between the decorative end caps. This is accomplished by hinge 16 opening in clam-shell fashion. Generally, it is noted that end caps 24 and 26 may be decorated in various ways including decorative wall 28, jewels 30 and cabochon jewels 32.

Figure 2:
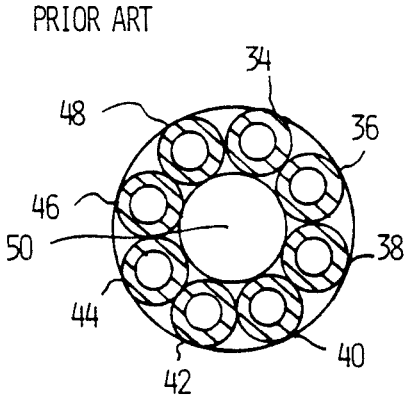
FIG. 2 is a cross-sectional representation along lines 2—2 of FIG. 1 of the material of FIG. 1.

Generally, the material illustrated in FIGS. 1 and 2 comprises a plurality of simple metal pipes 34–48, which have a simple cylindrical form and which are wound around a hollow central area 50 in the configuration of eight interlocking helixes. Typically, tubes 34–48 are made of sterling silver or jewelry quality gold alloy.

Figure 3:
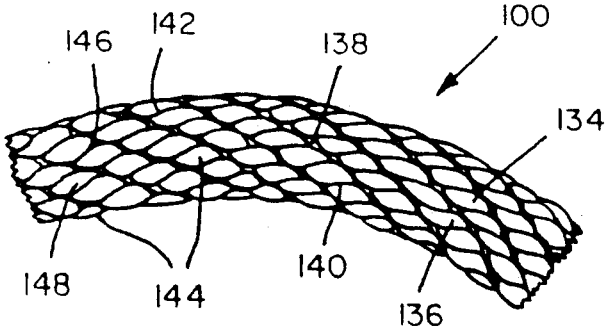
FIG. 3 is a plan view of a curved length of the inventive tubular material.

An alternative embodiment is illustrated in FIG. 3. Generally, similar parts or parts performing analogous, corresponding or identical functions are numbered herein with numbers which differ from those of the other embodiments by multiples of one hundred.

A bent length of the inventive band material 100 is illustrated in FIG. 3. In accordance with the present invention, tubes 134–148 are wound in interlocking helical fashion in much the same manner as the prior art band material of FIG. 1. However, tubes 134–148 are each provided with an crown and pit or groove or textured surface.

Figure 4:
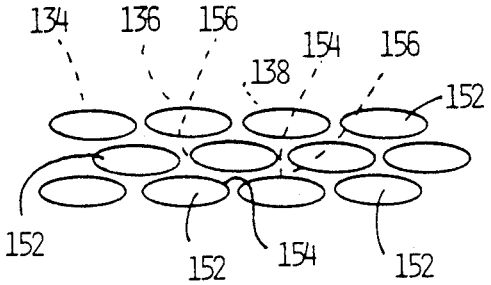
FIG. 4 a diagrammatic representation of the inventive material illustrated in FIG. 3.

In accordance with one particular embodiment of the present invention, the helical ridge-like crowns 152 of adjacent pipes, as illustrated in FIG. 4, for example, pipes 134 and 136 or pipes 136 and 138, interlock to form a tight pleasing configuration, as illustrated diagrammatically in FIG. 4. In one embodiment, the crown may take the form of convex surfaces which appear in a plan view of an individual pipe which has been unwound for illustrative purposes in the view of FIG. 5. These crowns 152, in FIG. 5, while they appear pointed at both ends may, for purposes of analysis, be represented as oval in form as in FIG. 4. These crowns and grooves are disposed in an interlocking matrix in which the peak surfaces 154 extend into trough surfaces 156 of adjacent pipes as illustrated in phantom lines in FIG. 4.

Figure 5:
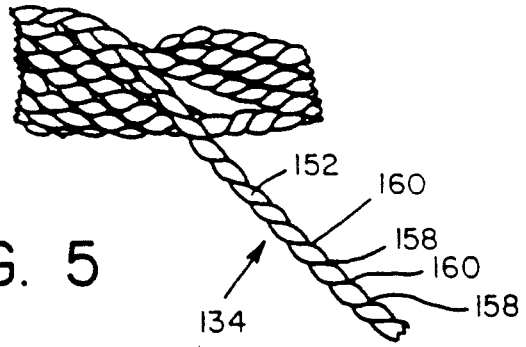
FIG. 5 is a plan view of the inventive band structure with an individual tube bent away to reveal its structure.

In the case of the embodiment of FIG. 5, each pipe has two helically configured grooves 158 and 160 embossed into and winding around its surface.

Figure 6:
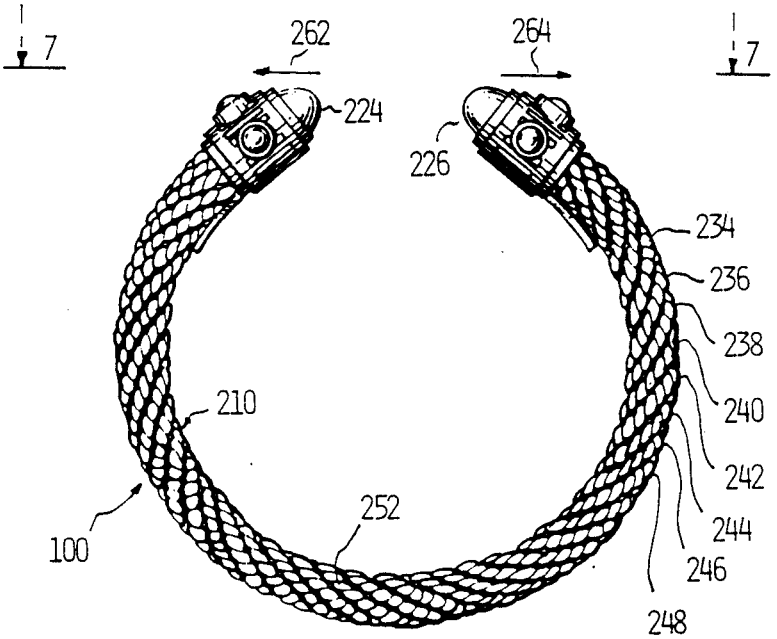
FIG. 6 is a plan view of a bracelet incorporating the inventive tubular material.
Figure 7:
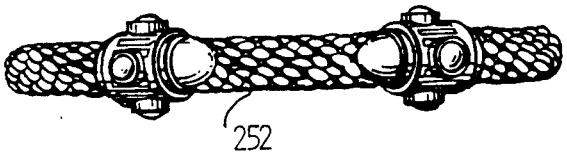
FIG. 7 is a top view of the bracelet illustrated in FIG. 6, along phantom lines 7—7 after outward flexure of the bracelet.

A bracelet 210 utilizing the inventive material 100 is illustrated in FIG. 6. Generally, this bracelet includes a pair of decorative end caps 224 and 226 and is formed from eight individual grooved pipes 234–248. Because of the properties of the inventive material 100, it is possible to flex end caps 224 and 226 open in the direction of arrows 262 and 264, causing the bracelet to open to the position illustrated in FIG. 7, allowing the wrist of the user to pass between the end caps without the need for hinges or similar structure.

Figure 8:
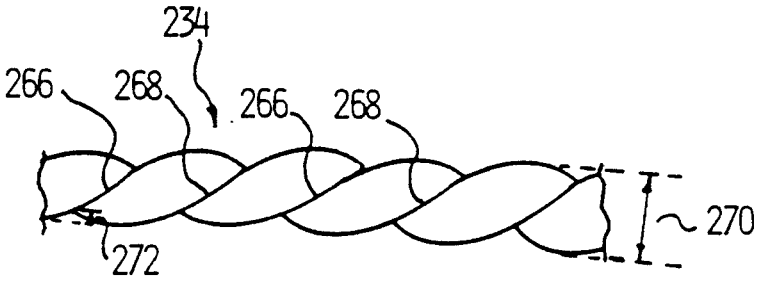
FIG. 8 is a plan view of a pipe useful in fabricating the inventive band material.

The structure of each of the individual pipes 234–238, which make up the jewelry item illustrated in FIG. 6, is shown in detail in FIG. 8. Generally, each of the pies, such as illustrated pipe 234, is a hollow tubular member with a grooved surface formed by the indentation of a pair of grooves 266 and 268, which wind around pipe 234 in helical fashion. The grooves are disposed with equal pitches and placed at equal distances from each other at a distance of half the pitch of a single groove, whereby the individual portions of each groove visible at a given time appear to be equispaced from each other i.e., forming a double helix. These grooves may be formed, for example, by taking a plain pipe, such as that used to manufacture the bracelet of FIG. 1, and pressing the groove into its outer cylindrical sidewall.

Generally, the outer diameter 270 of the pipes 234–248 is in the range of about 0.18 cm. The depth 272 of the grooves is on the order of about 0.02 cm. In accordance with the preferred embodiment, the pipes are made of sterling silver, or ten, fourteen, or eighteen caret gold and grooves are embossed with a density of approximately seven turns every 2.54 cm. The thickness of the side walls of pipes 234–248 is on the order of 0.024 cm.

Figure 9:
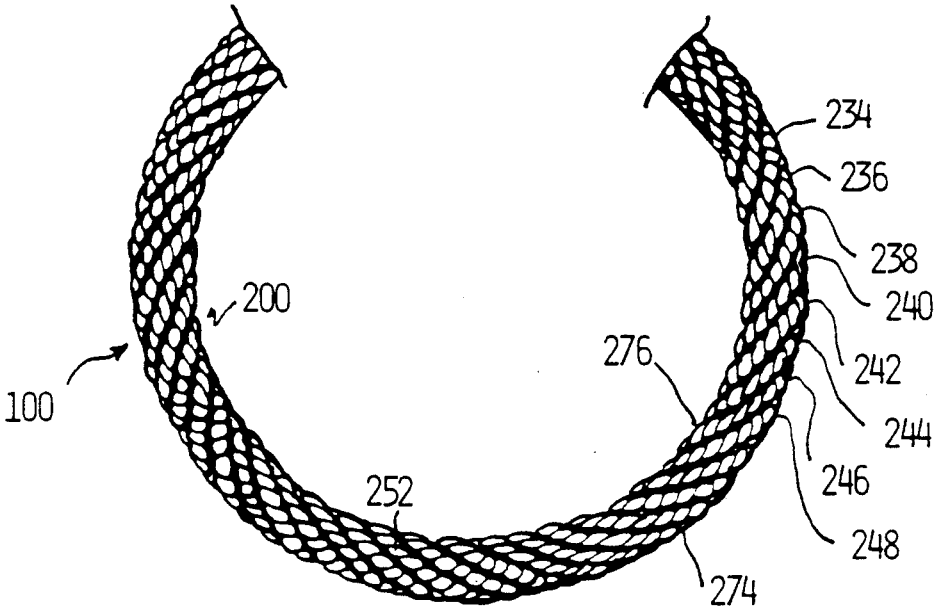
FIG. 9 is a plan view of a section of inventive material useful for making a bracelet such as that illustrated in FIG. 6.

The bracelet band material is wound to have an outer diameter of approximately 0.73 cm. In the case of a silver bracelet, pipes, of weight sufficient to give an undecorated band of the inventive material, such as that illustrated in FIG. 9, having an outer circumference 274 of 17.8 cm. and an inner circumference 276 of 13.6 cm., a weight of approximately 15 grams, are used. By inner and outer circumference is meant that portion of the inventive band material 100 which is actually illustrated in FIG. 9. The term circumference is used instead of length, insofar as the actual length of the material 100 is best defined in terms of a portion of the circumference of a theoretical circle defined by the band.

Further, in accordance with a preferred embodiment, it is noted that the helical grooves embossed in the pies, as illustrated in FIG. 8, are embossed in the pies with a left-hand orientation. Conversely, the individual pipes are bent into interlocking helixes having a right-hand configuration. The use of opposite orientations in the embossing and the bending results in an interlocking arrangement illustrated in the drawings and schematically laid out in FIG. 4.

Figure 10:
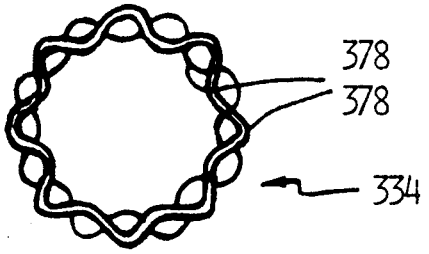
FIG. 10 is a cross-sectional view of an alternative pipe material.
Figure 11:
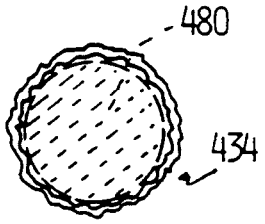
FIG. 11 is a cross-sectional view of yet another pipe material according to the invention.

In accordance with the invention, it is also possible for individual pipes, such as pipe 234, which form the interlocking, helically-formed band material to have different configurations other than that illustrated in FIG. 8. For example, if desired, the pipes can have a plurality of cabochon shapes embossed in their surfaces as illustrated in FIG. 10. The cabochons 378 are evenly and geometrically dispersed along the side wall of pipe 334. Still other alternatives exist including irregular textures such as those illustrated in pipe 434 in FIG. 11, or the use of a pipe with a solid interior 480 as illustrated in FIG. 11 in phantom lines.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A flexible jewelry band material, comprising a plurality of substantially identical generally tubular hollow members, each of said hollow members having a central longitudinal axis, said hollow members all being formed with their respective axes in the same generally helical configuration, said hollow members being substantially equispaced about a circle to form a band material surface, with the axes of said hollow members extending in spaced relationship to each other along the lengths of said hollow members and said hollow members being configured and dimensioned to bear against each other at a plurality of points extending along the length of said tubular hollow members, said hollow members interlocking to form a self-supported, and substantially closed in cross-section unitary hollow band material, each of said hollow members being positioned adjacent two other hollow members and wherein the surface of each of said hollow members is impressed with the form of a helix, wherein said helixes impressed on said hollow members are disposed with a first orientation and said hollow members are formed into said interlocking helixes with a second, opposite orientation.

2. A material as in claim 1, wherein said cylindrical members are filled with a solid material.

3. A material as in claim 1, wherein said hollow members are made of gold.

4. A material as in claim 1, wherein said hollow members are made of silver.

5. A material as in claim 1, wherein the impressed helixes define troughs and result in adjacent peaks, at least several peaks of one hollow member substantially fitting into troughs of adjacent hollow members.

6. A material as in claim 5, wherein said material comprises eight individual hollow members.

7. A material as in claim 1, further comprising an additional helix substantially parallel to said impressed helix.

8. A material as in claim 1, wherein said band material comprises eight cylindrical members.

9. A flexible jewelry band material as in claim 1, wherein said impressed helices define crowned portions and grooves, the crowned portions of tubular hollow members extending into the indented portions of adjacent hollow members.

* * * * *